US005492459A

United States Patent [19]

Burkett et al.

[11] Patent Number: 5,492,459

[45] Date of Patent: Feb. 20, 1996

[54] SWASH PLATE COMPRESSOR HAVING A CONICALLY RECESSED VALVED PISTON

[75] Inventors: Michael J. Burkett, Lockport; Nikolaos A. Adonakis, Grand Island, both of N.Y.

[73] Assignee: General Motors Corporation, Detroit, Mich.

[21] Appl. No.: 338,298

[22] Filed: Nov. 14, 1994

[51] Int. Cl.[6] ..... F04B 53/12

[52] U.S. Cl. ..... 417/550; 417/562; 137/512.15; 92/181 R

[58] Field of Search ..... 417/269, 550, 417/551, 552, 562; 137/512.15; 92/172, 177, 181 R, 181 P

[56] References Cited

U.S. PATENT DOCUMENTS

| | | | |
|---|---|---|---|
| 815,911 | 3/1906 | Eddy | 417/269 |
| 1,616,128 | 2/1927 | Knox | 417/562 |
| 2,296,883 | 9/1942 | Trask | 417/550 |
| 4,145,163 | 3/1979 | Fogelbert et al. . | |
| 4,174,191 | 11/1979 | Roberts . | |
| 4,261,689 | 4/1981 | Takahashi | 417/550 |
| 4,351,227 | 9/1982 | Copp, Jr. et al. . | |
| 5,163,819 | 11/1992 | Pettitt | 417/269 |
| 5,266,015 | 11/1993 | Gannaway | 417/550 |

FOREIGN PATENT DOCUMENTS

| | | | |
|---|---|---|---|
| 203883 | 12/1982 | Japan | 417/269 |
| 10172 | 1/1983 | Japan | 417/269 |
| 6093966 | 4/1994 | Japan | 417/269 |
| 528015 | 3/1940 | United Kingdom | 417/269 |

OTHER PUBLICATIONS

Nippondenso drawing "Structure" dated May 19, 1992, one sheet.

*Primary Examiner*—Richard A. Bertsch
*Assistant Examiner*—Roland G. McAndrews, Jr.
*Attorney, Agent, or Firm*—Patrick M. Griffin

[57] ABSTRACT

A swash plate compressor with single ended pistons improves piston stability by providing the ends of the pistons with open, conical rims, the outer surfaces of the which match, and thereby enlarge, the outer surface area of the pistons. The pistons therefore have increased sliding support within the cylinder bores, but without significant added mass. The pistons work in cooperation with matching conical protrusions on the discharge valve plate, which substantially fill the interior of the rims at piston full stroke. The piston compression ratio is therefore kept substantially the same.

1 Claim, 2 Drawing Sheets

SWASH PLATE COMPRESSOR HAVING A CONICALLY RECESSED VALVED PISTON

This invention relates to air conditioning compressors in general, and specifically to a one sided piston for a swash plate compressor which provides extra stability without adding significantly to the weight or manufacturing complexity of the piston, and without substantially affecting its compression ratio.

BACKGROUND OF THE INVENTION

Automotive air conditioning compressors of the swash plate type reciprocate a plurality of pistons back and forth within close fitting cylinder bores, compressing refrigerant vapor between the ends of the pistons and a valve plate. A swash plate drive mechanism inherently creates a side load on the reciprocating pistons which, if not adequately resisted, can lead to piston cocking within the cylinder bore, and the vibration, noise and scuffing that results therefrom. Larger capacity compressors often have two headed or two ended pistons, which are driven by a centrally located swash plate. An example may be seen in commonly assigned U.S. Pat. No. 4,351,227. As one end of each piston is driven forward, its opposite end is pulled back, and vice versa. Such designs have the advantage of excellent piston stability, because the two piston ends are widely spaced apart and provide mutual support. This allows the front end of the pistons to be cylindrical, solid and relatively axially short.

Smaller volume compressors have one sided pistons, the sliding ends of which are located all on one side of the swash plate. This provides much less inherent piston stability, and requires extra piston axial length to get an equivalent degree of sliding support surface area. One known means for increasing the effective axial length and sliding surface area of the piston without a large increase in mass is to simply make the piston longer, but hollow. An example may be seen in U.S. Pat. No. 4,145,163. As disclosed there, the type of mechanical interconnection between the swash plate and the piston is a rod with a ball and socket at each end. This necessitates that the hollow piston be open at the back end, in order to clear the horizontally extending rod, meaning that the piston is not as stiff as it would be if it were closed at each end. The same patent shows another attempt to save piston weight, though it is not explicitly described. The metal thickness necessary in the piston head for the ball and socket is localized in a boss at the center of the piston, so a clearance hole in the valve plate is provided to clear the piston boss. When a different type of interconnection between a one sided piston and the swash plate is used, the so called ball and shoe connection as is shown in U.S. Pat. No. 4,351,227 then there is no rod to clear the back of the piston. The piston may then be made hollow, but closed at each end, and therefore stiffer. Such a piston design must be made in at least two pieces, however, since metal cannot be effectively blow molded. Furthermore, it would be difficult at best to provide suction ports through a hollow piston closed at both ends.

SUMMARY OF THE INVENTION

The invention provides a single ended piston with increased outer surface area and stability which is still effectively solid and one piece, but not excessively massive.

In the embodiment disclosed, the solid piston is machined with a concave, generally conical rim at the front end, which opens toward a discharge valve plate. The outer surface of the rim is coextensive with the rest of the outer surface of the cylindrical piston body, and so provides more effective bearing surface area in contact with the cylinder bore. The piston is still basically solid, and can be machined from a single piece, but it is not as massive as it would be if it were as long, but flat at the front. In order to allow such a piston of unconventional shape to operate without a substantial decrease in compression ratio, a novel valve plate is provided to cooperate with the piston. A matching conical protrusion is aligned with the open conical end of each piston. As the piston reaches the end of its forward stroke, the conical protrusion enters and fills the open piston end, closing up what would otherwise be empty volume that would limit the compression of the refrigerant. The invention also provides the potential for providing a lower capacity compressor, should that be desired, with very little change in componentry. By providing a valve plate with smaller protrusions, which do not completely fill the concavity in the pistons, the compression ratio can be selectively reduced.

DESCRIPTION OF THE PREFERRED EMBODIMENT

These and other features of the invention will appear from the following written description, and from the drawings, in which.

Figure 1:
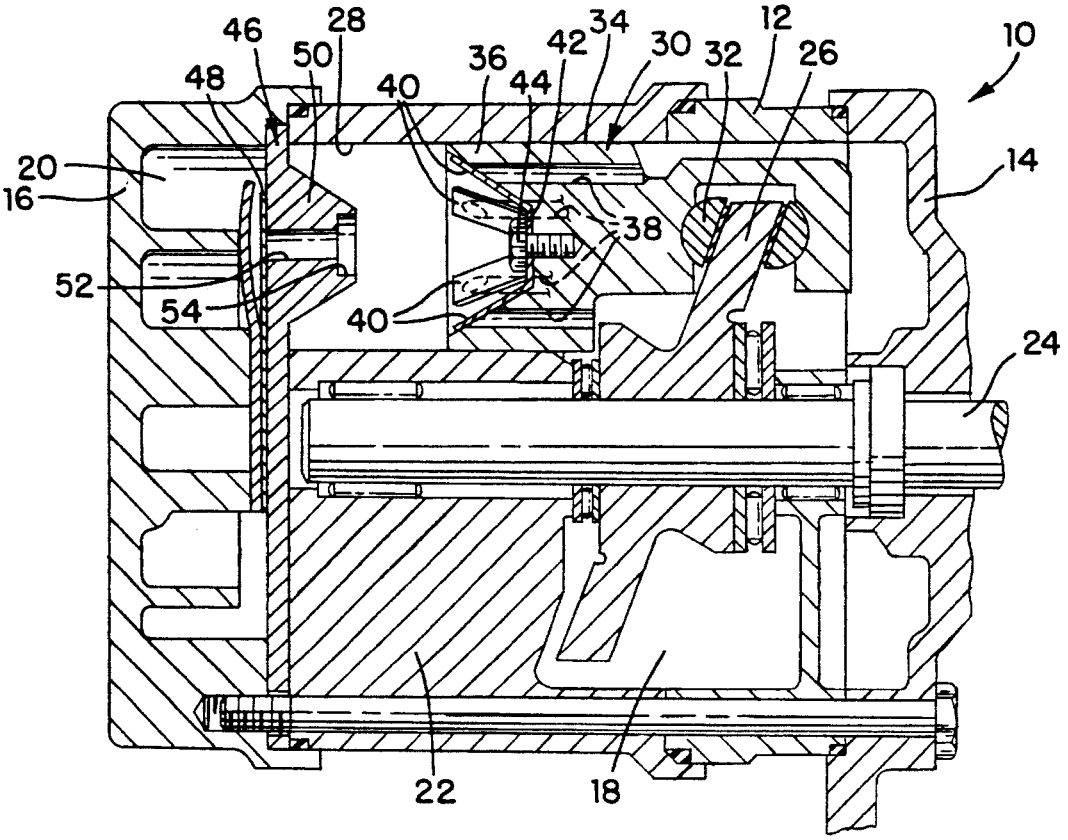
FIG. 1 is a cross section through a compressor made according to the invention, showing one piston and its corresponding portion of the valve plate at the retracted position of the stroke.

Referring first to FIG. 1, a compressor made according to the invention, indicated generally at 10, has several conventional features. A cylindrical housing 12, closed by a rear head 14 and front head 16, encloses a sealed interior volume generally called the crankcase 18. Front head 16 would have refrigerant inlet and outlet ports, not illustrated. The inlet admits low pressure refrigerant to the crankcase 18, while a front head discharge passage, partially visible at 20, directs compressed refrigerant out to the outlet. Housing 12 mates to a cylinder block, indicated generally at 22. The center of block 22 rotatably supports a central drive shaft 24, which in turn supports a nutating swash plate 26. Within cylinder block 22 are several evenly spaced cylindrical bores 28, each of which opens at one end to crankcase 18, and opens at the other end, indirectly, to the front head discharge passage 20.

The components described thus far are not appreciably different from a conventional compressor, but for the fact that the total compressor length is somewhat greater than it would be for a compressor of conventional construction, for a reason described below.

Figure 3:
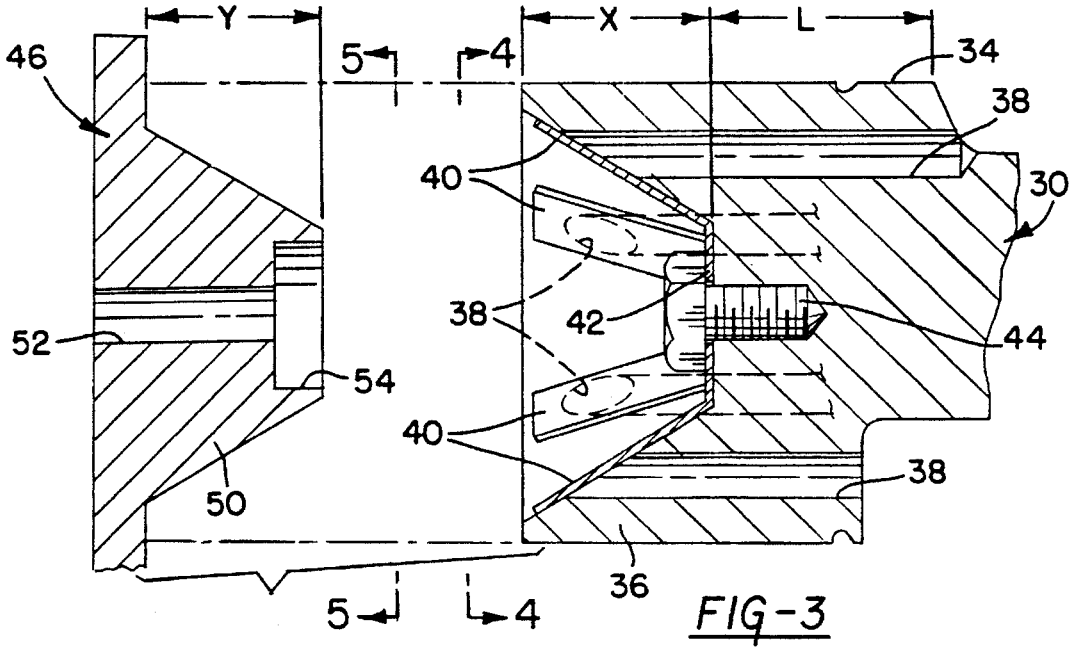
FIG. 3 is an enlargement of just the end of one piston and the corresponding portion of the valve plate.
Figure 4:
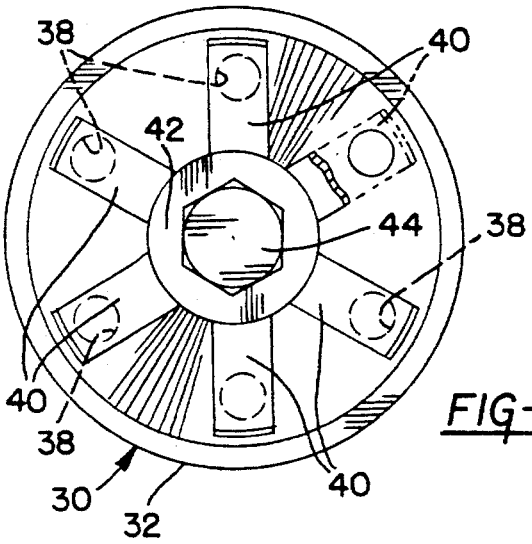
FIG. 4 is a view from the perspective of line 4—4 of FIG. 3.

Referring next to FIGS. 1, 3 and 4, the pistons, one of which is indicated generally at 30, are basically a solid cylinder that fits closely and slidably within a respective cylinder bore 28. The back end of each piston 30 is operatively joined by a conventional ball-shoe assembly 32 to the edge of the nutating swash plate 26, which causes it to reciprocate as shaft 24 turns. As it slides, the piston's cylindrical outer surface 34 guides and keeps piston 30 coaxial to bore 28. The effectiveness of the guiding, for a piston of a given diameter, is proportional to the axial length of the piston outer surface 34 within bore 28. Unfortunately, for a conventional solid piston of given diameter, its weight and inertia are also proportional to axial length, which is why they are typically relatively short. A conventional solid piston would have a greatest effective axial length L, as indicated in FIG. 3. Here, piston 30 is effectively given extra axial length, but without most of the added weight, and also without the manufacturing problems inherent in making a hollow piston. The front end of each piston 30 comprises a generally conical, outwardly opening rim 36, flat at the bottom. Rim 36 should not be conceptualized as a concave bore machined to a depth of X into the end of a solid piston of length L plus X, but as an addition X that is almost half again the length of a piston of otherwise conventional length L. Consequently, the length of the bore 28, as well as the length of the housing 12, must also be longer than they typically would, by at least the amount X, so as to accommodate the added length of piston 30. The outer surface of rim 36 is coextensive with the outer surface 34 of piston 30, and so slides within bore 28 to give it a very significant degree of extra guiding support. Piston 30 also includes six evenly spaced suction ports 38 that open at one end to the crankcase 18, and at the other end through the conical inner surface of rim 36. A specially designed suction reed valve comprises six evenly spaced fingers 40, which radiate from a central disk 42, disposed about the same conical surface as rim 36. Each finger 40 covers a respective suction port 38, held in place by a bolt 44 through disk 42. The fingers 40 flex to admit low pressure refrigerant from crankcase 18 into bore 28, while preventing back flow. Each piston 30 cooperates with a specially designed valve plate, described next.

Figure 5:
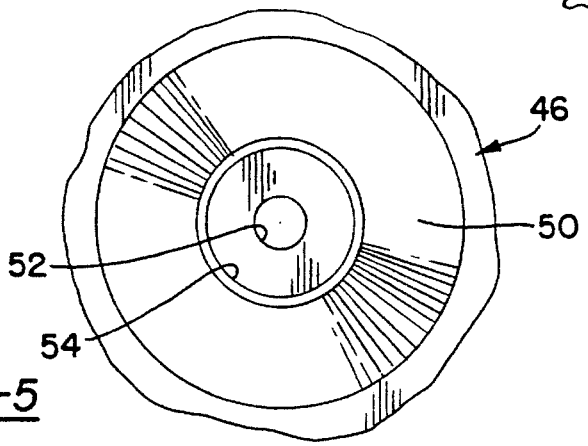
FIG. 5 is a view from the perspective of line 5—5 of FIG. 3.

Referring again to FIGS. 1, 3 and 5, a valve plate, indicated generally at 46, is basically a round plate clamped between the front of cylinder block 22 and front head 16. As with conventional valve plates, valve plate 46 supports a one way discharge reed valve 48 for admitting compressed refrigerant into discharge passage 20. Unlike conventional valve plates, however, valve plate 46 is not flat, but is formed with a plurality of truncated conical protrusions 50, each of which is aligned with a piston rim 36. In addition, the height Y of each conical protrusion 50 substantially equals X, and its shape substantially matches the shape of the inner surface of a piston rim 36. A central discharge port 52 through each protrusion terminates in an enlarged clearance bore 54, which is just larger than the head of a bolt 44.

Figure 2:
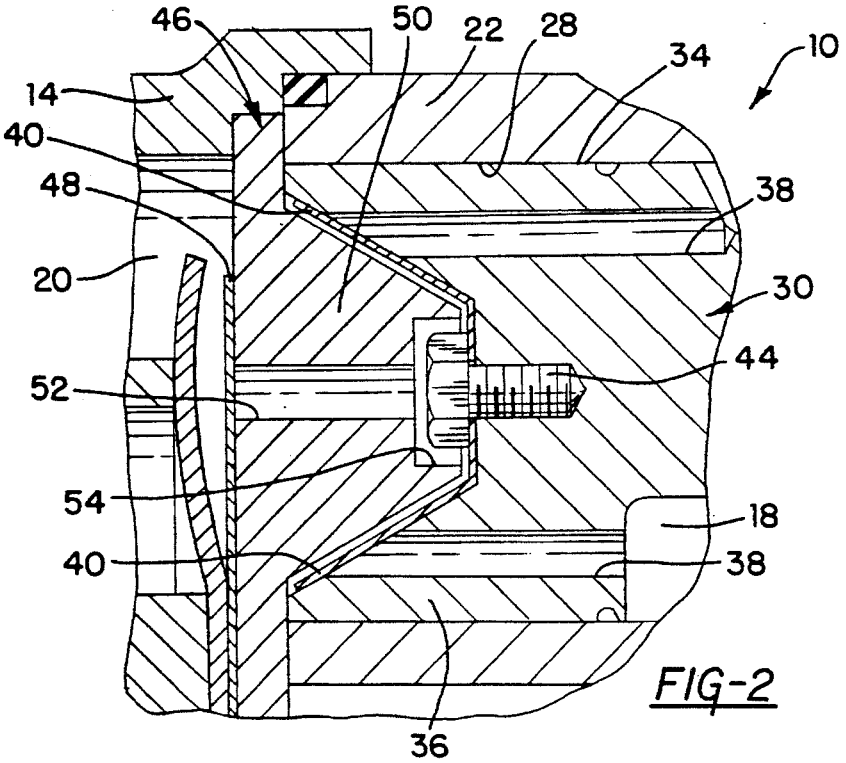
FIG. 2 is an enlargement of the relevant portion of the end of the piston at the forward portion of the stroke.

Referring next to FIGS. 1 and 2, the operation of compressor 10 is illustrated. As any of the pistons 30 retracts to the FIG. 1 position, a negative pressure is created between its front end and valve plate 46, drawing refrigerant in through the suction ports 38 and past the suction reed fingers 40. As the piston 30 slides (either retracting or extending), it is well supported and guided by the additional length of the outer surface of rim 36 within the correspondingly longer cylinder bore 28. As piston 30 extends toward the FIG. 2 position, the refrigerant drawn in is compressed toward the valve plate 46, raising its pressure, and opening discharge reed valve 48. At the top of the stroke, the protrusion 50 substantially fills the open end of piston rim 36. The head of bolt 44 enters clearance bore 54, so that the close spacing of the matching surfaces can be achieved, without increasing the diameter of discharge port 52. Consequently, the compression ratio and the volume of refrigerant left unexpelled from the cylinder bore 28 is substantially the same as in a conventional, flat ended piston. The extra power needed to drive the additional mass of piston 30 is not substantial, since the rim 36 is effectively hollow. Still, machining piston 30 is not substantially more expensive than machining a conventional, flat ended piston, since it is unitary, and the rim 36, being at the front of piston 30, is easily accessed during manufacture. A conventional lathe or turning machine will serve.

Figure 6:
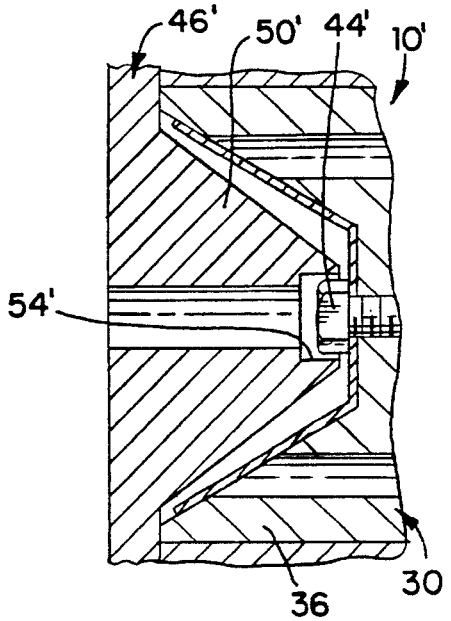
FIG. 6 is a view like FIG. 3, but showing an alternative embodiment.

Referring next to FIG. 6, an alternative embodiment of compressor 10, indicated generally at 10', is illustrated. All of the components are common, and numbered correspondingly, but for the valve plate, indicated generally at 46', and the suction valve attachment bolt 44'. Valve plate 46' is the same diameter and thickness as plate 46, and so fits into the same basic structural package, but has narrower conical protrusions 50', and a smaller truncated top. The clearance bore 54' is therefore somewhat smaller in diameter, as is the attachment bolt 44'. As piston 30 extends to the end of its compression stroke, there is some portion of unfilled volume left between the conical inner surface of piston rim 36 the deliberately narrower conical protrusion 50'. This reduces proportionately the compression ratio, but also reduces the power necessary to drive the pistons 30. Therefore, if a smaller capacity, smaller power compressor is desired within the same basic structural framework, it can be provided with only a different valve plate 46' and smaller diameter bolt 44'. The pistons 30 and every other component remain basically unaltered.

Variations in the embodiment disclosed could be made. The piston rim 36 could have a different interior shape, so long as it was concave, substantially hollow, and had a cylindrical outer surface matching the rest of piston surface 34. For example, it could be a blind cylindrical bore of equivalent depth Y, rather than a truncated conical bore of depth Y. However, there are several advantages to the conical interior shape of rim 36. It is stronger at its juncture with the rest of piston 30 than a cylindrical bore would be, having no sharp, stress rising corner. In addition, a conical inner surface, unlike a straight one, still has a component in the plane perpendicular to the center axis of piston 30. Therefore, it is still possible to drill straight suction ports like 38 through it. These, apart from having an elliptical opening, rather than a circular opening, operate just as in a conventional piston. There is also room for a suction reed valve, the only significant modification of which is to make the fingers 40 angled and somewhat longer, rather than flat. If the interior surface of the rim 36 were a straight, cylindrical bore, then the suction ports 38, as a practical matter, would have to be drilled through the bottom of the bore, and there would be much less room for a operable suction reed valve, which would have short, stiffer fingers. Therefore, it will be understood that it is not intended to limit the invention to just the embodiment disclosed.

The embodiments of the invention in which an exclusive property or privilege is claimed are defined as follows:

1. In a compressor having a refrigerant crankcase and a cylindrical piston with a front end reciprocating closely within a cylindrical bore so as to compress refrigerant between the piston front end and a valve plate, and in which said piston front end further includes a concave, conical rim having an inner surface facing said valve plate, and in which a convex, conical protrusion on said valve plate substantially matches and aligns with the inner surface of said piston conical rim, the improvement comprising, a plurality of evenly spaced suction ports opening through said conical rim inner surface, and, a suction reed valve fixed to said piston front end and including a plurality of evenly spaced, flexible fingers disposed about the same conical surface as the inner surface of said rim, each of which covers a respective suction port, whereby said fingers flex to admit refrigerant from said crankcase and into said bore, while preventing back flow.

* * * * *